US009039114B2

(12) United States Patent
Furukawa

(10) Patent No.: US 9,039,114 B2
(45) Date of Patent: May 26, 2015

(54) INKJET RECORDING APPARATUS

(71) Applicant: KYOCERA DOCUMENT SOLUTIONS INC., Osaka (JP)

(72) Inventor: Noriaki Furukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/166,420

(22) Filed: Jan. 28, 2014

(65) Prior Publication Data

US 2014/0210885 A1 Jul. 31, 2014

(30) Foreign Application Priority Data

Jan. 29, 2013 (JP) ..... 2013-014705

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01); *B41J 2/04593* (2013.01); *B41J 2/04596* (2013.01)

(58) Field of Classification Search
USPC ..... 347/9, 10, 11, 15, 12, 14
See application file for complete search history.

(56) References Cited

U.S. PATENT DOCUMENTS 6,290,315 B1 * 9/2001 Sayama ..... 347/10

FOREIGN PATENT DOCUMENTS

| | | | |
|---|---|---|---|
| JP | 06-286143 | A | 10/1994 |
| JP | 2002-160370 | A | 6/2002 |
| JP | 2002-187267 | A | 7/2002 |
| JP | 2005-059326 | A | 3/2005 |
| JP | 2009-101515 | A | 5/2009 |

* cited by examiner

*Primary Examiner* — Lam S Nguyen
(74) *Attorney, Agent, or Firm* — Studebaker & Brackett PC

(57) ABSTRACT

An inkjet recording apparatus includes a head driving section that includes a drive pulse generator and a selector. The drive pulse generator generates, as the waveforms of drive voltage to be applied to the piezoelectric elements, a plurality of drive waveforms that includes an ink-ejection drive waveform defined according to the number of times of ink ejection to be made from the corresponding nozzle, and a reset waveform which causes greater drawing of the meniscus in the corresponding nozzle than by the ink-ejection drive waveform. With respect to each nozzle, the selector selects to apply which of the drive waveforms generated by the drive pulse generator or not to apply any of the drive waveforms to the corresponding piezoelectric element.

10 Claims, 16 Drawing Sheets

INKJET RECORDING APPARATUS

INCORPORATION BY REFERENCE

The present application claims priority under 35 U.S.C. §119 to Japanese Patent Application No. 2013-014705, filed Jan. 29, 2013. The contents of this application are incorporated herein by reference in their entirety.

BACKGROUND

The present disclosure relates to inkjet recording apparatuses for performing recording by ejecting ink onto a recording medium, such as paper, and in particular to recovery of a recording head used to eject ink.

Recording apparatuses, such as facsimile machines, copiers, and printers, are structured to record images onto a recording medium, such as paper, cloth, or an overhead projector film, for example. Such recording apparatuses can be classified into an inkjet type, a wire dot type, and a thermal type according to the method employed for the recording. The inkjet recording method can further be classified into a serial head type and a line head type. A recording apparatus of the serial head type performs recording while moving the recording head across the recording medium. A recording apparatus of the line head type performs recording with the recording head fixed to the main body.

A recording apparatus of the inkjet type includes a plurality of nozzles each for ejecting ink. Unfortunately, in a nozzle that is placed standby or not used for printing, ink may thicken and thus the linearity of ink ejection may decrease (trajectory deflection) or failure of ink ejection may occur. In addition, trajectory deflection of the ejected ink may occur at the time of successive print operations. Trajectory deflection may result in image quality degradation or contamination by the ink within the apparatus. The cause of such trajectory deflection has been clarified to be meniscus abnormality. For example, meniscus abnormality may be caused by dispersion particles or surfactant components adhered to or precipitated in the nozzle. Meniscus abnormality may also be caused by ink mists or foreign matter (paper dust or the like) adhered to the nozzle.

Piezoelectric inkjet heads are widely used as the recording heads for inkjet recording apparatuses. A piezoelectric inkjet head deforms a piezoelectric element to apply pressure to the ink in a pressure chamber, which then causes the ink meniscus in the nozzle to oscillate so that ink droplets are ejected.

The piezoelectric inkjet head may change the size of ink droplets to be ejected so as to reproduce gradation within one image. To this end, pulses of the drive waveform applied to cause ejection of ink droplets are changed to control oscillation of the meniscus. However, the meniscus is instable due to the presence of the incoming flow of ink into the pressure chamber (inertance), which may impair the linearity of the trajectory of ejected ink.

In view of the above, various methods have been suggested to suppress occurrence of meniscus abnormality.

For example, in one method suggested, occurrence of meniscus abnormality is suppressed by devising the nozzle shape. More specifically, providing a projection on an edge of the nozzle is suggested in the method. In another method suggested, the peripheral edge of a nozzle is projected from the nozzle plate so as to cause the meniscus of ink to be formed at the end face of the nozzle orifice.

In a yet another method suggested, the inner wall of a nozzle is treated to impart ink-repellency and ink-affinity to improve the surface property of the nozzle.

In a yet another method suggested, a cleaning fluid is supplied to the nozzle surface and the nozzle surface is cleaned with a brush.

In a yet another method suggested, the angle formed between the meniscus edge and the nozzle plate is made larger at the time of ejection driving for idle striking to recover the ejection function of the nozzle than at the time of ejection driving for actually ejecting ink to form images. As a result, foreign matter residing near the nozzle plate is integrated into ink droplets and removed at the time of practice ejection.

SUMMARY

An inkjet recording apparatus according to one aspect of the present disclosure includes: a recording head having a plurality of nozzles for ejecting ink onto a recording medium; and a head driving section for causing the recording head to eject the ink the number of times determined according to a gradation value of each of a plurality of pieces of pixel data constituting image data to be printed. The recording head includes a plurality of pressure chambers and a plurality of piezoelectric elements. The plurality of pressure chambers are in communication with the respective nozzles and configured to contain ink inside. The plurality of piezoelectric elements are disposed in correspondence with the respective pressure chambers and each cause the ink to be ejected from the corresponding pressure chamber to the corresponding nozzle. The head driving section includes a drive pulse generator and a selector. The drive pulse generator generates, as the waveforms of drive voltage to be applied to the piezoelectric elements, a plurality of drive waveforms that includes an ink-ejection drive waveform defined according to the number of times of ink ejection to be made from the corresponding nozzle, and a reset waveform which causes greater drawing of the meniscus in the corresponding nozzle than by the ink-ejection drive waveform. With respect to each nozzle, the selector selects to apply which of the drive waveforms generated by the drive pulse generator or not to apply any of the drive waveforms to the corresponding piezoelectric element.

DETAILED DESCRIPTION

Figure 1:
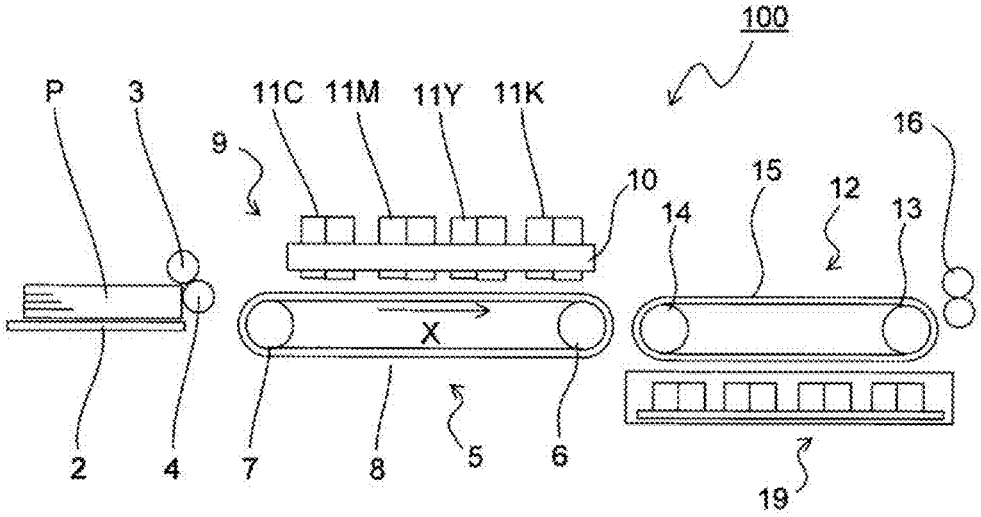
FIG. 1 shows a schematic structure of an inkjet recording apparatus according to an embodiment of the present disclosure.
Figure 2:
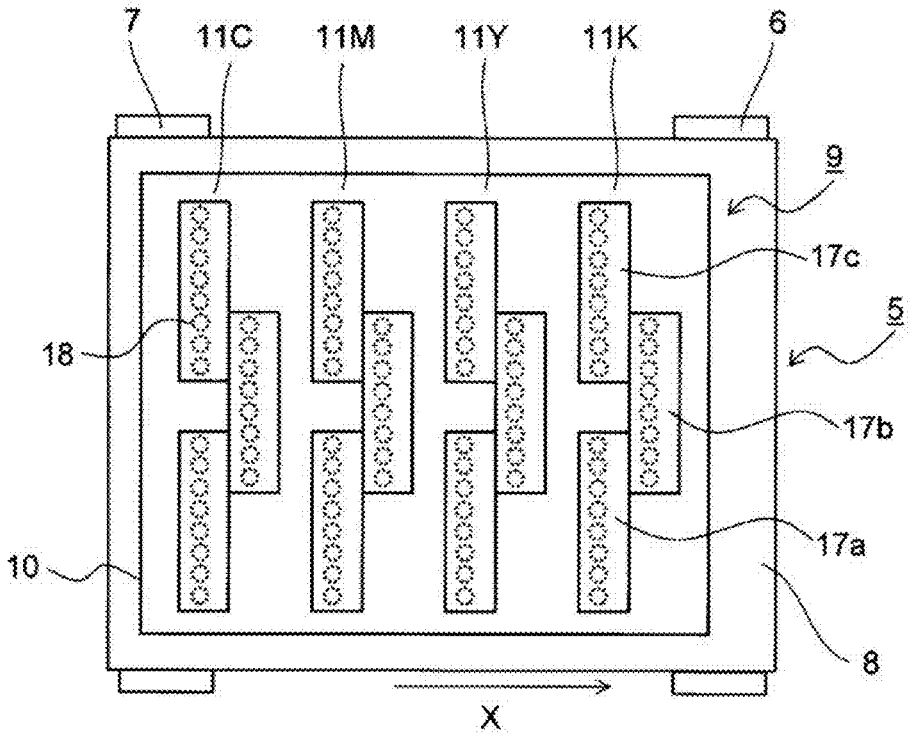
FIG. 2 is a plan view showing a first conveyance unit and a recording section both included in the inkjet recording apparatus shown in FIG. 1.

The following now describes an embodiment of the present disclosure, with reference to the accompanying drawings. FIG. 1 shows a schematic structure of an inkjet recording apparatus 100 according to the present embodiment. FIG. 2 is a plan view showing a first conveyance unit 5 and a recording section 9 both included in the inkjet recording apparatus 100 shown in FIG. 1.

As shown in FIG. 1, disposed on a side (left side in FIG. 1) of the inkjet recording apparatus 100 is a paper feed tray 2 storing paper P (recording medium). Disposed in the vicinity of the paper feed tray 2 (right side in FIG. 1) are a paper feed roller 3 and a driven roller 4. The paper feed roller 3 feeds the paper P stored in the paper feed tray 2 to the later-described first conveyance unit 5 sheet by sheet from the topmost one. The driven roller 4 is pressed against the paper feed roller 3 so as to rotate by receiving power transmitted from the paper feed roller 3.

Disposed downstream (X-direction side) from the paper feed roller 3 and the driven roller 4 are the first conveyance unit 5 and the recording section 9. The first conveyance unit 5 conveys the paper P in a predetermined conveyance direction (X direction). The first conveyance unit 5 includes a first drive roller 6 disposed downstream (X-direction side) in the conveyance direction, a first driven roller 7 disposed upstream in the conveyance direction, and a first conveyance belt 8 wound around the first drive roller 6 and the first driven roller 7. As the first drive roller 6 rotates clockwise in FIG. 1, the paper P held on the first conveyance belt 8 is conveyed downstream (toward X-direction side).

In the embodiment, the first drive roller 6 is disposed downstream in the conveyance direction. With this arrangement, the conveyance surface (the upper surface in FIG. 1) of the first conveyance belt 8 is pulled by the first drive roller 6. As a result, the tension of the conveyance surface of the first conveyance belt 8 is increased, and thus stable conveyance of paper P can be ensured. The first conveyance belt 8 is preferably formed from a sheet of dielectric resin. In addition, the first conveyance belt 8 is preferably a belt with no joint (seamless belt).

The recording section 9 includes a head housing 10 and lineheads 11C, 11M, 11Y, and 11K. The lineheads 11C, 11M, 11Y, and 11K eject ink of mutually different colors. For example, the linehead 11C ejects cyan ink, the linehead 11M ejects magenta ink, the linehead 11Y ejects yellow ink, and the linehead 11K ejects black ink. In the following description, the lineheads 11C, 11M, 11Y and 11K are each referred to as a linehead 11 in the case where no distinction among them is necessary (in the case where their common characteristics are described).

The respective lineheads 11 are secured to a head housing 10. In addition, each linehead 11 is disposed to have a predetermined gap (1 mm, for example) from the conveyance surface of the first conveyance belt 8.

As shown in FIG. 2, each linehead 11 includes a plurality of (three, in the present embodiment) recording heads 17*a*-17*c*. Each of the recording heads 17*a*-17 includes a plurality of nozzles 18. The recording heads 17*a*-17*c* are in a staggered arrangement along the width direction of the paper P (the top and bottom direction in FIG. 2), which is a direction perpendicular to the conveyance direction of the paper P. With this arrangement, one or more of the nozzles 18 included in the recording head 17*a* overlap with one or more of the nozzles 18 included in the recording head 17*b* in the conveyance direction. In addition, one or more of the nozzles 18 included in the recording head 17*c* overlap with one or more of the nozzles 18 included in the recording head 17*b* in the conveyance direction. Each linehead 11 has a recording region that is wider than the width of the paper P conveyed. At the time of printing, each nozzle 18 corresponding to the printing position ejects ink to the paper P which is conveyed on the first conveyance belt 8.

In the embodiment, inks of the four colors (cyan, magenta, yellow, and black) are stored in respective ink tanks (not shown). The inks of the colors (cyan, magenta, yellow, and black) respectively corresponding to the linehead 11C, 11M, 11Y, and 11K are supplied to the recording heads 17*a*-17*c* constituting the respective lineheads 11. In the following description, the recording heads 17*a*, 17*b*, and 17*c* are each referred to as a recording head 17 in the case where no distinction among them is necessary (in the case where their common characteristics are described).

In the present embodiment, each recording head 17 is a piezoelectric inkjet head. The piezoelectric inkjet head transmits pressure produced by deforming a piezoelectric element 31 (see FIG. 3) to the ink within the nozzle 18 to oscillate the meniscus thereby to form ink droplets.

The paper P is conveyed by being sucked to the conveyance surface of the first conveyance belt 8. Each recording head 17 ejects ink from the nozzles 18 to the paper P based on image data received from an external computer or the like. For example, ink is ejected from the respective recording heads 17 of each of the lineheads 11C, 11M, 11Y, and 11K, so that the inks of the four colors, namely cyan, magenta, yellow, and black, is superimposed to form a color image on the paper P conveyed on the first conveyance belt 8.

At the start of printing after a long halt, it is preferable to execute purging for every recording head 17 to be ready for the subsequent print operation. Also, during the interval between successive print operations, it is preferable to execute purging for each recording head 17 that ejects ink in an amount below a preset value, so that such a recording head 17 will be ready for the subsequent print operation. By executing purging, ink thickened within the nozzle 18 is ejected. As a result, failure of ink ejection caused by ink drying or nozzle clogging in the recording heads 17 can be suppressed.

As shown in FIG. 1, a second conveyance unit 12 is disposed downstream (X-direction side) from the first conveyance unit 5 in the conveyance direction. The second conveyance unit 12 includes a second drive roller 13 disposed downstream (X-direction side) in the conveyance direction and a second driven roller 14 disposed upstream in the conveyance direction, and a second conveyance belt 15 wound around the second drive roller 13 and the second driven roller 14. As the second drive roller 13 rotates clockwise in FIG. 1, the paper P held on the second conveyance belt 15 is conveyed downstream (toward X-direction side).

The paper P on which an image is formed by the recording section 9 is conveyed to the second conveyance unit 12. While the paper P passes through the second conveyance unit 12, ink adhered on the surface of the paper P dries. In addition, a maintenance unit 19 is disposed below the second conveyance unit 12. The maintenance unit 19 moves to the location below the recording section 9 when purging described above is executed. The maintenance unit 19 wipes off ink ejected from the nozzles 18 of each recording head 17 and collects the ink that is wiped off.

In addition, disposed downstream (toward X-direction side) from the second conveyance unit 12 is an ejection roller pair 16 for ejecting the paper P on which an image is recorded to the outside of the apparatus. Disposed downstream (toward X-direction side) from the ejection roller pair 16 in the conveyance direction is an exit tray (not shown) for receiving paper P ejected out of the main body.

Figure 3:
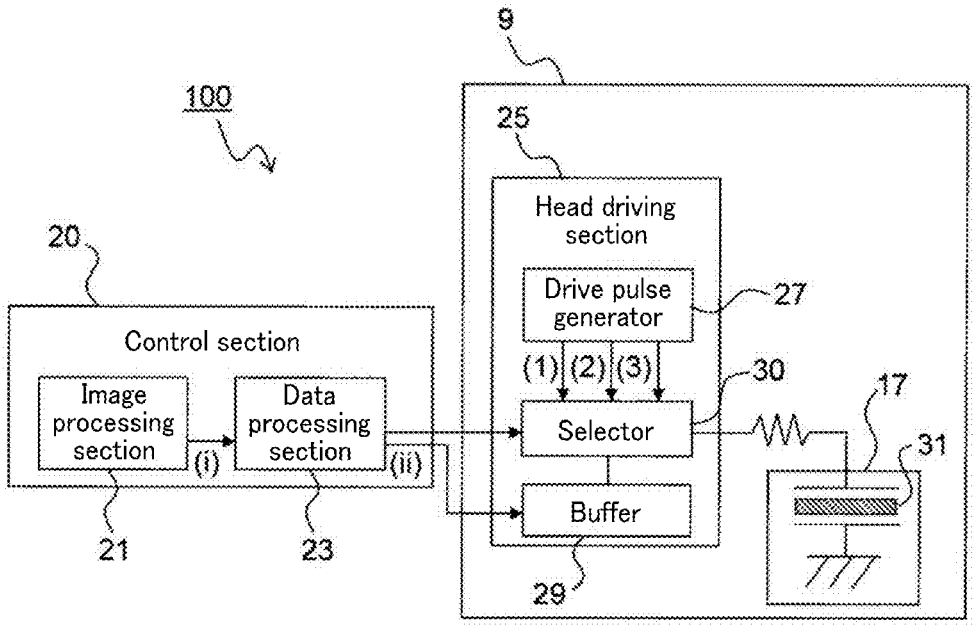
FIG. 3 is a block diagram showing an example of a control system of the inkjet recording apparatus according to the embodiment of the present disclosure.
Figure 4:
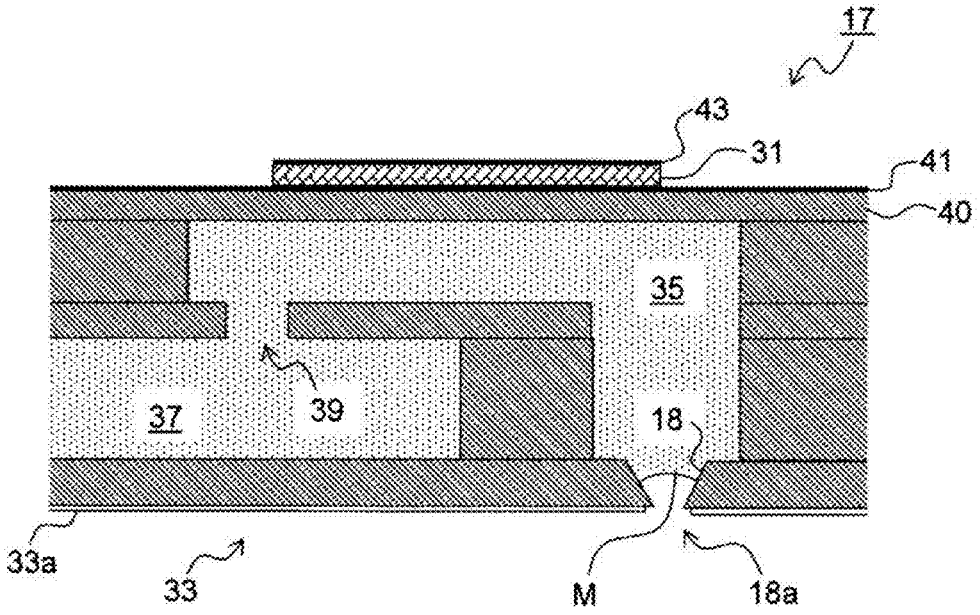
FIG. 4 is a sectional view showing a structure of a recording head included in the inkjet recording apparatus according to the embodiment of the present disclosure.

With reference mainly to FIGS. 3 and 4, the following now describes one mode of control executed by the recording section 9 of the inkjet recording apparatus 100 according to the present disclosure. FIG. 3 is a block diagram showing an example of the control system used by the inkjet recording apparatus 100 according to the embodiment of the present disclosure. FIG. 4 is a sectional view showing a structure of the recording head 17.

The inkjet recording apparatus 100 includes a control section 20 for executing control mainly related to image processing. The control section 20 includes an image processing section 21 and a data processing section 23. The control section 20 further includes a non-illustrated central processing unit (CPU) and memory (ROM and RAM). The CPU executes a program stored in the ROM as necessary. The image processing section 21 and the data processing section 23 are each implemented by a circuit or program, for example.

The image processing section 21 generates print data (i). The print data (i) describes, in multi-value gradation, pieces of pixel data constituting image data to be printed.

The data processing section 23 generates drive-waveform selection data (ii). The drive-waveform selection data (ii) indicates the number of times of ink ejection to be made from each nozzle 18 for the gradation value of a corresponding piece of pixel data constituting the print data (i). The drive-waveform selection data (ii) also indicates, to a later-described selector 30, whether or not to apply a drive voltage corresponding to a predetermined waveform (for example, either a first drive waveform (1), a second drive waveform (2), or a third drive waveform (3) all of which will be described later) to each piezoelectric element 31.

According to the present embodiment, a plurality of types of waveforms are generated as a drive waveform to be applied to the piezoelectric elements 31. The drive waveform to be generated includes: an ink-ejection drive waveform defined according to the number of times of ink ejection to be made from the corresponding nozzle 18 (for example, the first drive waveform (1), which will be described later); and a reset waveform causing greater drawing of the meniscus in the corresponding nozzle 18 than by the ink-ejection drive waveform (for example, the third drive waveform (3)). The drive-waveform selection data (ii) indicates, to the later-described selector 30, which of the drive waveforms generated is to be selected.

The recording section 9 includes a head driving section 25 for driving each recording head 17. The head driving section 25 causes each recording head 17 to eject ink the number of times (one or more times) determined by the gradation value of a corresponding piece of pixel data constituting the image data to be printed. According to the embodiment, the head driving section 25 causes each recording head 17 to eject ink the number of times necessary to record the pixels arrayed in the conveyance direction of the image to be printed. According to the present embodiment, each nozzle 18 is used to record a pixel array in the conveyance direction. As a result, pixels are recorded on the paper P according to the pixel data.

The head driving section 25 includes a drive pulse generator 27, a buffer 29, and the selector 30.

The drive pulse generator 27 generates a plurality of types of pulse waveforms (for example, the first drive waveform (1), the second drive waveform (2), and the third drive waveform (3), all of which will be described later). The buffer 29 stores the drive-waveform selection data (ii) corresponding to a one-page image.

The selector 30 controls the drive voltage of each piezoelectric element 31 based on the drive-waveform selection data (ii) for one page. For example, the selector 30 selects one type of a drive waveform out of the plurality of types of waveforms generated by the drive pulse generator 27 (for example, out of the first drive waveform (1), the second drive waveform (2), and the third drive waveform (3), all of which will be described later), and applies the drive voltage corresponding to the selected waveform to the piezoelectric element 31. Alternatively, the selector 30 maintains the drive voltage of the piezoelectric element 31 at a constant level.

As shown in FIG. 4, each recording head 17 includes an ejection surface 33, a water-repellent film 33*a*, pressure chambers 35, an ink tank (not shown), and a common flow channel 37.

The ejection surface 33 faces the paper P. The ejection surface 33 has a plurality of discharge ports 18*a* of a minute diameter. The discharge ports 18*a* are the openings of the respective nozzles 18. The discharge ports 18*a* are spaced from one another at regular intervals in the longitudinal direction of the ejection surface 33 (the main scanning direction). The discharge ports 18*a* are disposed at least across the maximum width of the printing region.

The water-repellent film 33*a* covers the ejection surface 33 except for each discharge port 18*a*. The pressure chambers 35 are provided one for each discharge port 18*a*. The ink tank (not shown) stores ink. The common flow channel 37 forwards ink supplied from the ink tank to the respective pressure chambers 35.

The pressure chambers 35 are in communication with the common flow channel 37 via respective supply holes 39. Ink is supplied from the common flow channel 37 to the pressure chambers 35 via the respective supply hole 39. Each nozzle 18 is continuous from the pressure chamber 35 to the discharge port 18*a*.

Of the walls of the pressure chamber 35, the one located opposite to the ejection surface 33 is constructed of a vibration plate 40. The vibration plate 40 is formed to be continuous across the plurality of pressure chambers 35. On the vibration plate 40, a common electrode 41 is layered. Similarly to the vibration plate 40, the common electrode 41 is formed to be continuous across the plurality of pressure chambers 35. On the common electrode 41, the discrete piezoelectric elements 31 are disposed one for each pressure chamber 35. On the piezoelectric elements 31, discrete individual electrodes 43 are disposed one for each pressure chamber 35. Each piezoelectric element 31 is sandwiched between the common electrode 41 and the individual electrode 43.

To drive the respective recording heads 17, the drive pulse generator 27 of the head driving section 25 generates drive pulses (pulse waveform). The drive voltage corresponding to the thus generated drive pulses is applied to the individual electrodes 43. In response, the respective piezoelectric elements 31 deform. The deformation of each piezoelectric element 31 according to the drive voltage is transmitted to the vibration plate 40 to deform the vibration plate 40. The deformation of the vibration plate 40 further causes each pressure chamber 35 to be compressed. As a result, pressure is applied to the ink in the pressure chamber 35. The pressure causes the ink to flow through the nozzle 18 to be ejected out of the discharge port 18*a* as ink droplets onto the paper P. Note that some ink remains in the nozzles 18 even during the time no ink droplets are ejected. The ink forms a meniscus surface M in each nozzle 18.

Figure 5:
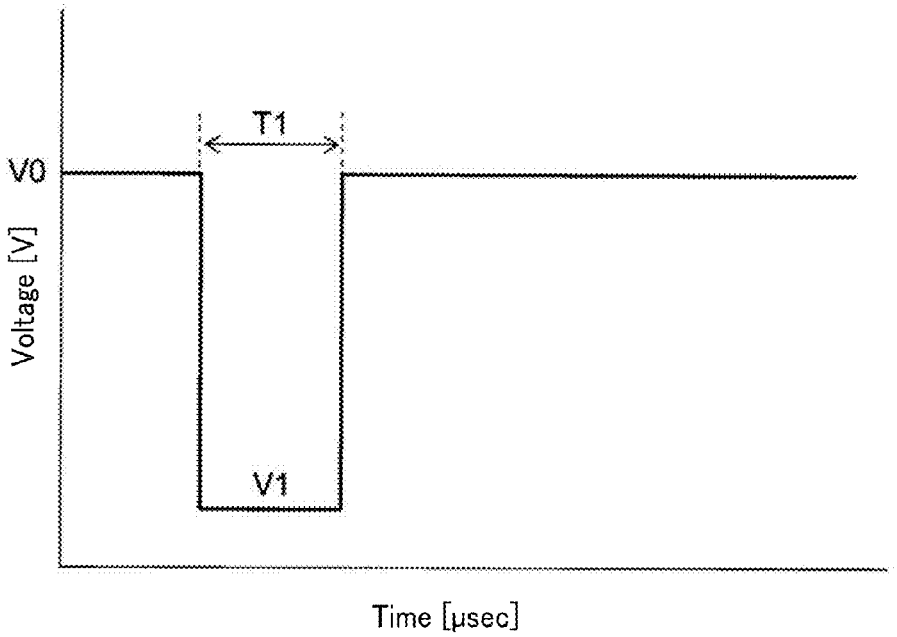
FIG. 5 shows a first drive waveform, which is an ink-ejection drive waveform.
Figure 6:
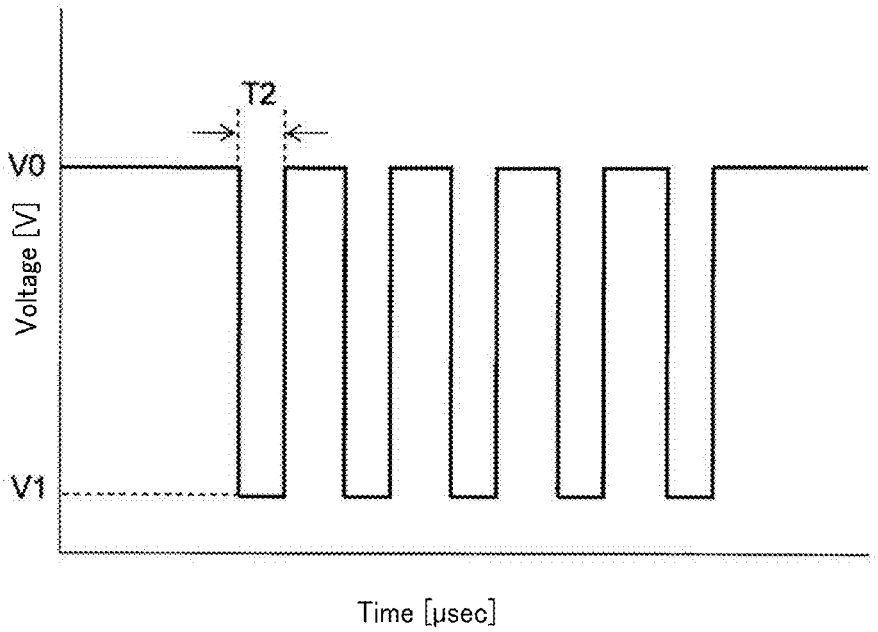
FIG. 6 shows a second drive waveform, which is a meniscus-oscillation drive waveform.
Figure 7:
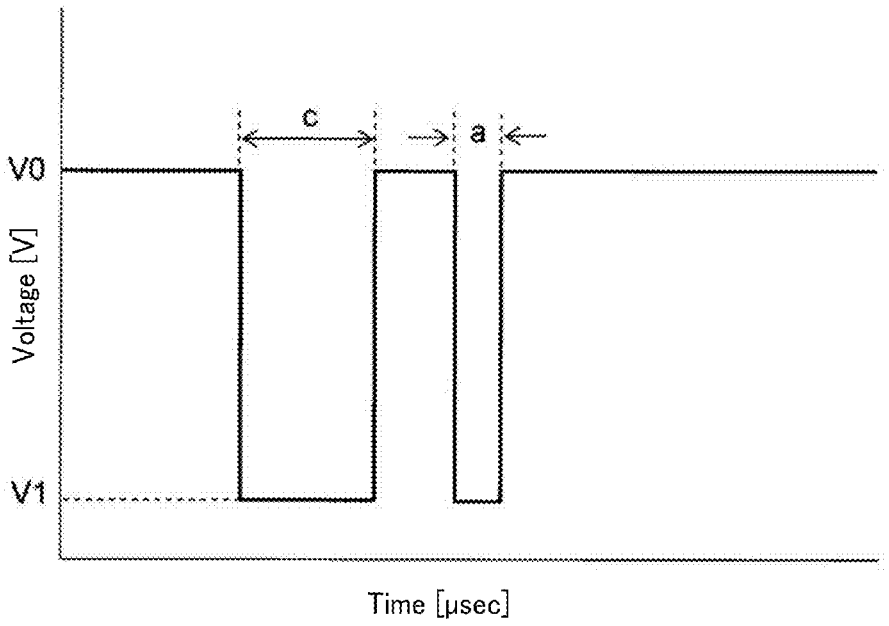
FIG. 7 shows a third drive waveform, which is a reset waveform.
Figure 8:
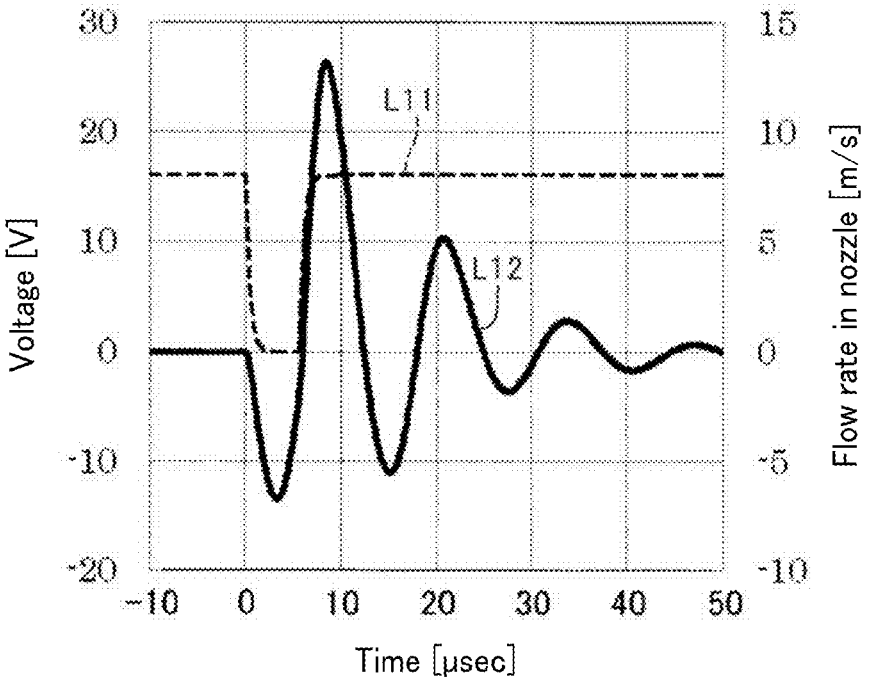
FIG. 8 is a graph showing the drive voltage applied to a piezoelectric element and the flow rate of the ink in a corresponding nozzle, when the first drive waveform is selected.
Figure 9:
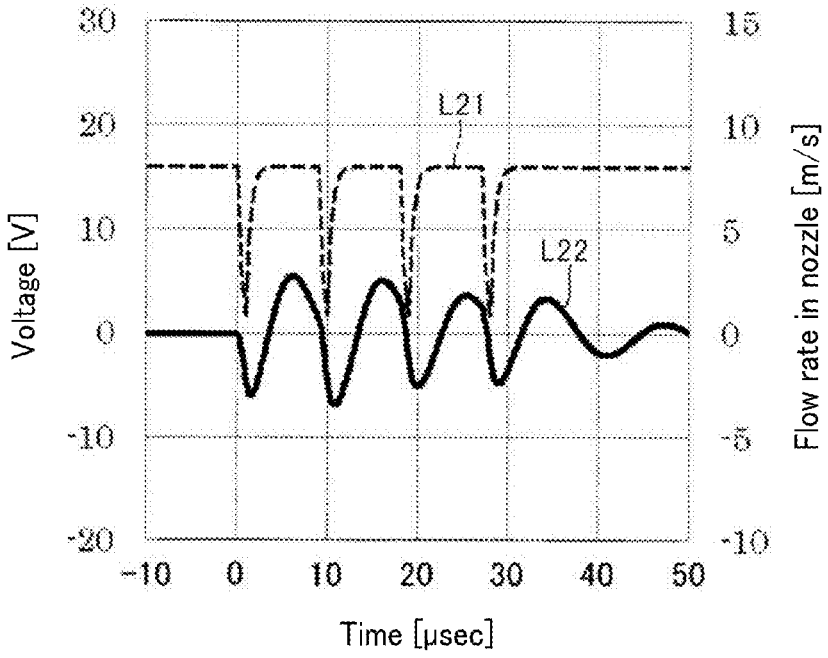
FIG. 9 is a graph showing the drive voltage applied to the piezoelectric element and the flow rate of the ink in the nozzle, when the second drive waveform is selected.
Figure 10:
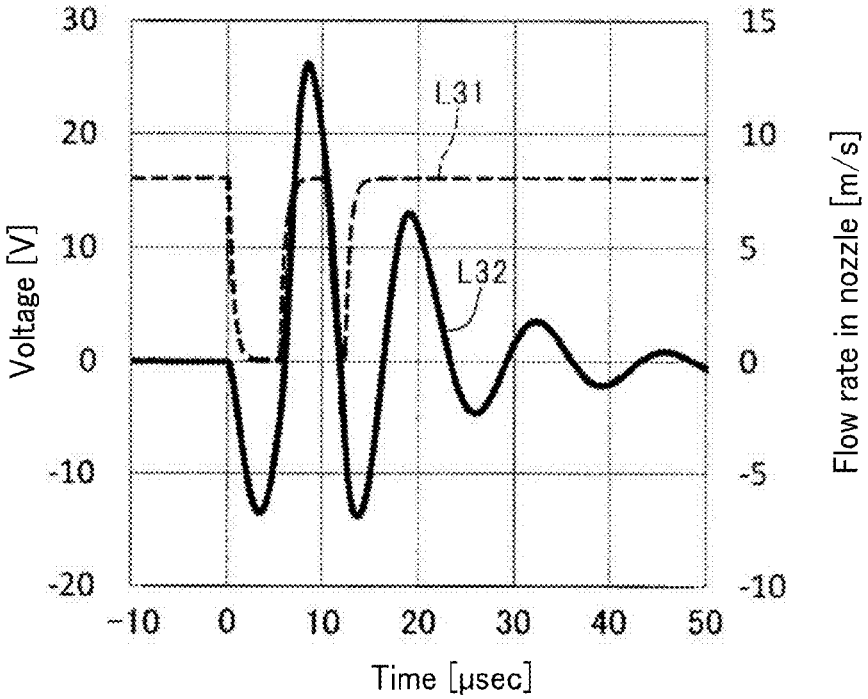
FIG. 10 is a graph showing the drive voltage applied to the piezoelectric element and the flow rate of the ink in the nozzle, when the third drive waveform is selected.
Figure 11A:
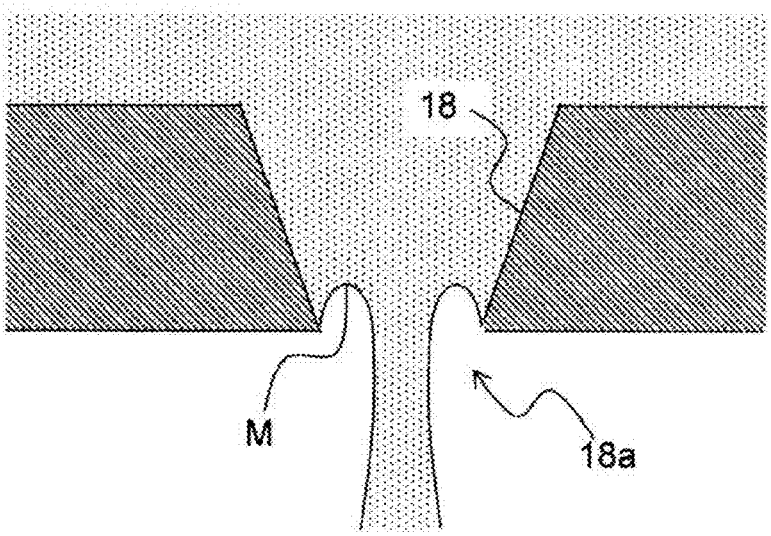
FIG. 11A is a sectional view illustrating the manner of ink ejection from the nozzle for which the first drive waveform is selected.
Figure 11B:
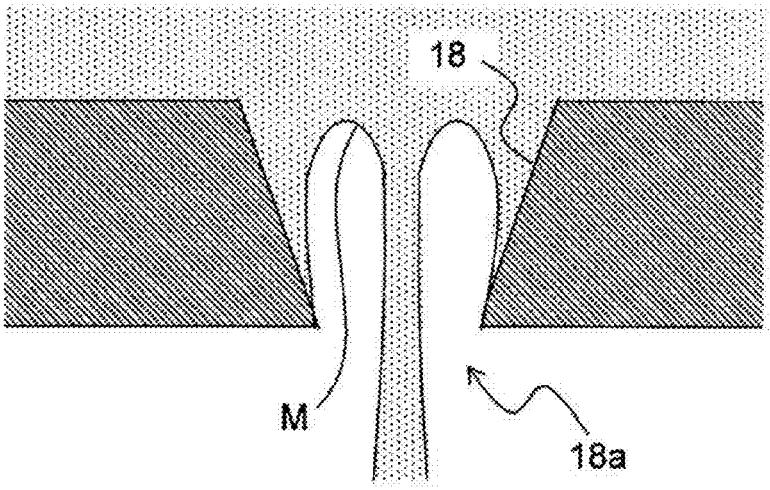
FIG. 11B is a sectional view illustrating the manner of ink ejection from the nozzle for which the third drive waveform is selected.

FIGS. 5, 6, and 7 respectively show the first drive waveform (1), the second drive waveform (2), and the third drive waveform (3) generated by the drive pulse generator 27. FIGS. 8, 9, and 10 each show a graph of the drive voltage applied to the piezoelectric element 31 and the flow rate of the ink in the nozzle 18, respectively when the first drive waveform (1), the second drive waveform (2), and the third drive waveform (3) are selected. FIGS. 11A and 11B are sectional views each showing the manner of ink ejection from the nozzle 18, respectively when the first drive waveform (1) and the third drive waveform (3) are selected.

The following describes the first drive waveform (1) mainly with reference to FIGS. 5, 8, and 11A. The first drive waveform (1) is used for normal ink ejection determined in advance for each gradation value of pixel data constituting image data to be printed (or for a specific number of times of ink ejection by the nozzle 18). The first drive waveform (1) corresponds to the drive-waveform selection data (ii) indicating the gradation value of 1. When the gradation value is 1, the head driving section 25 causes the recording head 17 to eject ink one time to form one pixel.

As shown in FIG. 5, with the first drive waveform (1), the voltage value (V1) falls below the voltage value of the drive source (V0) during the pulse width T1. The pulse width T1 is set, for example, to ½ of the natural oscillation period of the recording head.

When the first drive waveform (1) described above is selected, the drive voltage as shown in FIG. 8 with the line L11 is applied to the piezoelectric element 31. Then, as shown in FIG. 8 with the line L12, the flow rate of the ink in the nozzle 18 exceeds 10 m/s one time. Consequently, ink is ejected from the discharge port 18*a* one time as shown in FIG. 11A.

The following now describes the second drive waveform (2) mainly with reference to FIGS. 6 and 9. The second drive waveform (2) is determined in advance to cause the meniscus surface M to oscillate without causing ejection of ink droplets from the nozzle 18. The second drive waveform (2) is different from the first drive waveform (1).

As shown in FIG. 6, the second drive waveform (2) includes a plurality of pulses each having a pulse width T2 that is narrower than the pulse width T1 included in the first drive waveform (1). The frequency of the second drive waveform (2) is higher than that of the first drive waveform (1).

When the second drive waveform (2) described above is selected, the drive voltage as shown in FIG. 9 with the line L21 is applied to the piezoelectric element 31. Then, as shown in FIG. 9 with the line L22, the flow rate of the ink in the nozzle 18 never exceeds 10 m/s. Consequently, the meniscus surface M in the nozzle 18 is oscillated but no ink droplets are ejected.

It is preferable to cause oscillation of the meniscus surface M by the second drive waveform (2) during the time between the completion of printing of a sheet of paper P and the start of printing of a subsequent sheet of paper P (hereinafter, referred to as an interval between successive print operations) in every nozzle 18 that is to be used to eject ink at least one time for the subsequent sheet of paper P. In addition, it is preferable to set the number of oscillations of the meniscus surface M to be caused during an interval between successive print operations (the number of pulses included in the second drive waveform (2) applied to the piezoelectric element 31) to 100 times or more. Oscillating the meniscus surface M at least 100 times ensures the ink liquid in the nozzle 18 to be sufficiently agitated again. For this reason, even when the components of the ink liquid within the nozzle 18 are localized to make the ink liquid more transparent in the vicinity of the discharge port 18*a*, it is assumed that dots landed on the paper P are prevented from becoming transparent.

Note that when the meniscus surface M in the nozzle 18 is greatly oscillated immediately before dot formation, minute ink droplets with a low landing speed tend to be formed. Such minute ink droplets may be recognized as dust on the image. In view of this, the pulse width T2 of the second drive waveform (2) is preferably narrower than the natural oscillation period of the recording head 17. This can suppress occurrence of minute ink droplets resulting from oscillation of the meniscus surface M.

The following now describes the third drive waveform (3) mainly with reference to FIGS. 7, 10, and 11B. The third drive waveform (3) is a waveform (reset waveform) that causes greater drawing of the meniscus than by the first drive waveform (1).

As shown in FIG. 7, the third drive waveform (3) is a waveform in which a pulse having a pulse width c (=½ of the natural oscillation period of the recording head 17) that causes ink ejection is followed by one secondary pulse having a pulse width a that is narrower than ½ of the natural oscillation period of the recording head 17.

When the third drive waveform (3) described above is selected, the drive voltage as shown in FIG. 10 with the line L31 is applied to the piezoelectric element 31. Then, as shown in FIG. 10 with the line L32, the flow rate of the ink in the nozzle 18 exceeds 10 m/s one time. Consequently, ink is ejected from the discharge port 18*a* one time. In addition, application of the third drive waveform (3) causes the amplitude (peak-to-peak value) in the flow rate after the ink ejection to be larger than that caused by application of the first drive waveform (1). Therefore, as shown in FIG. 11B, the meniscus surface M is drawn deeper in the nozzle 18 when ink ejection is caused by the third drive waveform (3) than when ink ejection is caused by the first drive waveform (1) (see FIG. 11A).

Next, the following describes control of ink ejection by the recording head 17 of the inkjet recording apparatus 100 according to the present embodiment.

An inkjet recording apparatus using a piezoelectric inkjet head tends to suffer from biased ejection (trajectory deflection) in which the linearity of the ink ejected is decreased. Especially, in the case where a solid image is formed, streaks may appear as a result of uneven density. The cause of the biased ejection may be adhesion or precipitation of foreign matter or ink components or may be meniscus abnormality. Of these possible causes, for the meniscus abnormality, water repellency of the nozzle surface often serves as a parameter.

For example, after ink ejection, the meniscus surface M rises from the nozzle. At this time, if the contact angle between the meniscus surface M and the nozzle surface is small, a phenomenon occurs in which the ink spreads over the nozzle surface (hereinafter, referred to as meniscus overflow). Occurrence of meniscus overflow reduces the linearity of ejected ink, which may become a cause of biased ejection. For this reason, without a certain level of water-repellency of the nozzle surface, ink droplets ejected at the end of a print operation may suffer from biased ejection even if the total number of prints is one.

To address this, the inkjet recording apparatus 100 according to the present embodiment causes the image processing section 21 to perform image processing on the image data. The image processing section 21 generates print data (i) describing, in multi-value gradation (256 gradation values, for example), pieces of pixel data constituting image data to be printed. The data processing section 23 generates the drive-waveform selection data (ii) of, for example, two-value gradation based on the print data (i). Further, the data processing section 23 counts, for each pixel array in the conveyance direction within the one-page image, the number of pixels corresponding to the drive waveform selection data (ii) indicating a value other than 0 (for example, the gradation value 1). Still further, for recording a pixel array corresponding to the count value is 2 or greater, the data processing section 23 switches the drive waveform to be used for recording at least one pixel having a gradation value 1 (drive-waveform selection data (ii)) from the first drive waveform (1) to the third drive waveform (3).

The inkjet recording apparatus 100 according to the present embodiment uses the reset waveform (the third drive waveform (3)) to cause ink ejection when recording a predetermined pixel. The reset waveform causes greater drawing of the meniscus than by a normal ejection waveform (the first drive waveform (1)). With the use of the reset waveform, the meniscus surface M in the nozzle 18 can be separated from the ink having spread over the nozzle surface or from foreign matter adhered to the nozzle 18 in the vicinity of the opening (discharge port 18*a*). As a consequence, occurrence of biased ejection can be suppressed.

The reset waveform (the third drive waveform (3)) is for causing ejection of ink droplets. Therefore, application of the reset waveform during an interval between successive print operations may result in ink ejected onto the first conveyance belt 8 (see FIG. 1). Thus, ink may stain the back of the paper P. Further, application of the reset waveform to form blank pixels may cause formation of minute dots on an image on the paper P. As a consequence, such minute dots may be recognized as dust on the image. It is therefore preferable to switch the ejection waveform to be used for pixels other than blank pixels in the image, from the normal ejection waveform (first drive waveform (1)) to the reset waveform (third drive waveform (3)).

At the initial stage of use of the recording head 17, the nozzle surface has high water repellency. Therefore, the meniscus surface M after ink ejection rises uniformly from the nozzle and is drawn deeper in the nozzle 18 by oscillation. However, the nozzle surface eventually deteriorates to decrease in water repellency. Therefore, biased ejection may occur frequently. To suppress occurrence of biased ejection, it is preferable to execute switching from the first drive waveform (1) to the third drive waveform (3) for every page.

Note that a pixel to be recorded by switching the drive-waveform selection data (ii) from the normal ejection waveform (first drive waveform (1)) to the reset waveform (third drive waveform (3)) may be the first pixel, an intermediate pixel, or the last pixel of the image.

In the case where ink with water-based pigment is used, ink readily thickens due to drying of the ink at the meniscus surface M in the nozzle 18 in the case where the ink is ejected for the first pixel after a predetermined number or more consecutive non-ejection pixels. This tends to cause problems, such as inaccurate printing at the time of ink ejection or ejection failure. To avoid occurrence of such problems, it is preferable to switch the drive-waveform selection data (ii) corresponding to the first pixel in the one-page image to indicate the reset waveform.

In addition, to avoid occurrence of biased ejection, it is preferable to change the drive-waveform selection data (ii) corresponding to the last pixel in the one-page image to indicate the reset waveform. Even in the case of printing only one page, it is effective to reliably form the last dot so that occurrence of biased ejection can be suppressed. In addition, inaccurate image formation can be reduced at the upstream edge of the image in the conveyance direction.

As described above, it is preferable to form the first or last pixel of the one-page image by switching the ejection waveform to the reset waveform. In the case where aqueous ink is used, it is especially preferable to switch the ejection waveform for the first pixel to the reset waveform.

Figure 12:
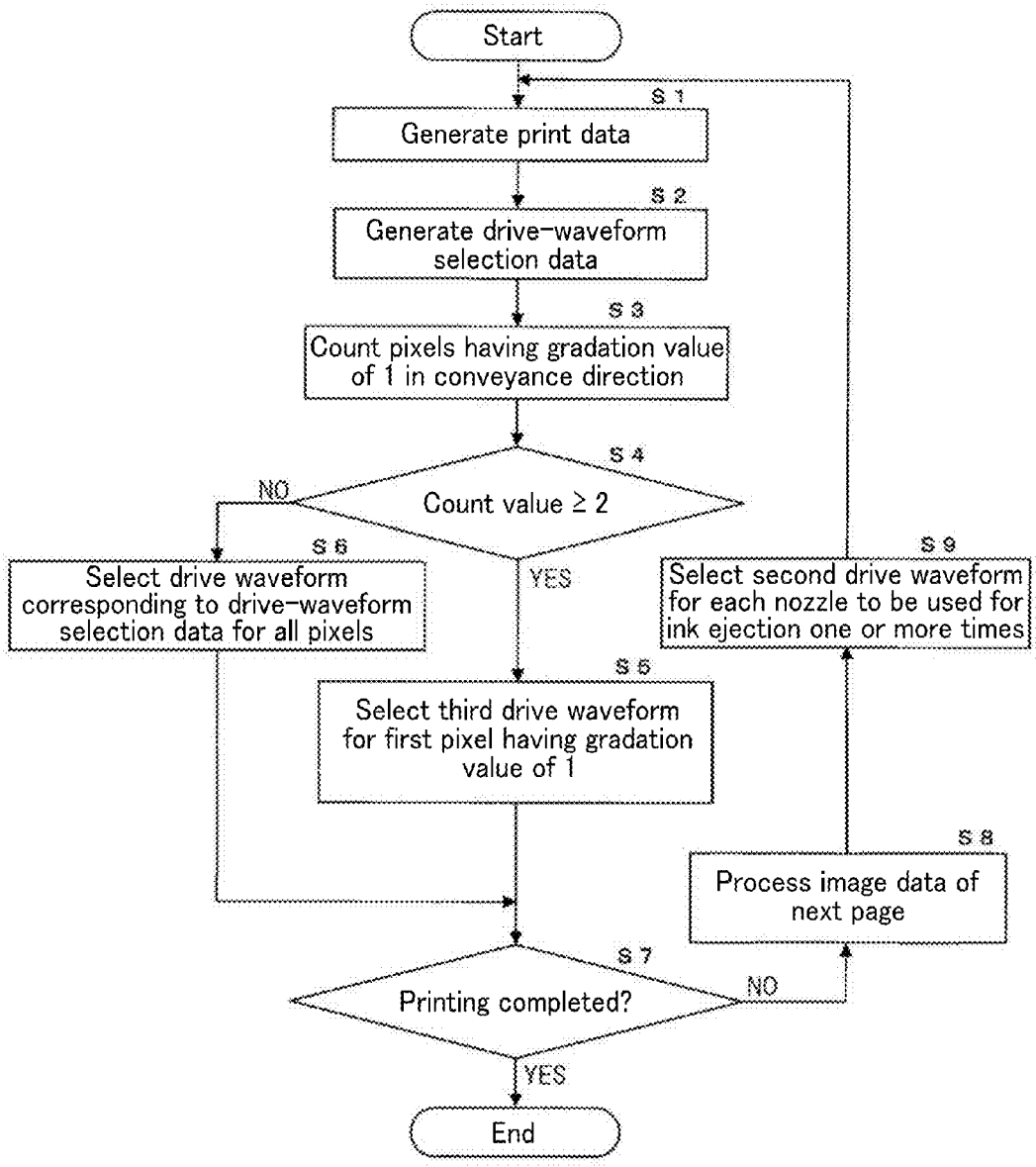
FIG. 12 is a flowchart showing a first sequence of an ink ejecting operation performed by the inkjet recording apparatus according to the embodiment of the present disclosure.

FIG. 12 is a flowchart showing a first sequence of an ink ejecting operation performed by the inkjet recording apparatus 100 according to the present embodiment. The following describes one example of the ink ejecting operation performed by the inkjet recording apparatus 100 for forming an image, mainly with reference to FIG. 12.

In response to an input of a print instruction and image data from the printer driver or the like of a personal computer (general-purpose computer) to the control section 20, the image processing section 21 included in the control section 20 generates print data (i) based on the image data thus input (Step S1). Subsequently, the image processing section 21 sends the print data (i) to the data processing section 23.

Then, the data processing section 23 converts the printing data (i) described in 256-value gradation to drive-waveform selection data (ii) described in two-level gradation (Step S2). Through this step, drive-waveform selection data (ii) is generated. The drive-waveform selection data (ii) is data indicating the number of times of ink ejection to be made from each nozzle 18 corresponding to the respective pieces of pixel data constituting the printing data (i). According to the present embodiment, each recording head 17 can form a dot in either of the two gradation values (gradation value 0 and 1).

Next, according to the arrays of the nozzles 18 included in the respective recording heads 17, the data processing section 23 sends the drive-waveform selection data (ii) corresponding to pieces of pixel data for the one-page image to the buffer 29. Next, the selector 30 sequentially reads drive-waveform selection data (ii) stored in the buffer 29, with timing synchronized with the drive frequency of the head driving section 25. The selector 30 then selects a drive waveform according to the drive-waveform selection data (ii).

Next, the control section 20 (CPU, for example) counts the number of pixels corresponding to the drive-waveform selection data (ii) indicating a value other than 0, for each pixel array in the conveyance direction of the one-page image data stored in the buffer 29 (and thus for each nozzle 18 corresponding to the pixel array) (Step S3). Subsequently, the control section 20 (CPU, for example) determines whether or not the count value is 2 or greater (Step S4).

When the count value for the pixel array corresponding to each nozzle 18 is determined to be 2 or greater (Step S4: YES), the selector 30 selects the third drive waveform (3), which causes greater drawing of the meniscus, as the drive waveform for the first pixel having a gradation value of 1 in the one-page image (Step S5). For recording the other pixels, the normal ejection waveform is selected to cause ink ejection. For example, for each pixel having a gradation value of 1, the first drive waveform (1) is selected. For each pixel having a gradation value of 0, no dot is formed. Therefore, the voltage value (V0) of the drive source is maintained.

On the other hand, when the count value is determined to be either 1 or 0 (Step S4: NO), the selector 30 selects the normal ejection waveform for all the pixels in each line of the image stored in the buffer 29 to cause ink ejection (Step S6). For example, for each pixel having a gradation value of 1, the first drive waveform (1) is selected. For each pixel having a gradation value of 0, no dot is formed. Therefore, the voltage value (V0) of the drive source is maintained.

Next, the control section 20 (CPU, for example) determines whether or not printing has been completed for the one page (Step S7). When the printing is determined to be continuing (Step S7: NO), the image processing section 21 processes the image data (print data) of the subsequent page (Step S8). Then, the selector 30 selects the second drive waveform (2) as the drive waveform for each nozzle 18 to be used for ejecting ink at least one time for the subsequent page (Step S9). As a result, the second drive waveform (2) causes the meniscus surface M to oscillate. Thereafter, the procedure in Steps S1 through S9 are repeated.

By carrying out the ink ejecting operation of each recording head 17 through the above procedure, the following is ensured with respect to each nozzle 18 used for ejecting ink a plurality of times. That is, the reset waveform (third drive waveform) is selected for such a nozzle to cause ink ejection one time out of the plurality of times. This arrangement enables the meniscus surface M in the nozzle 18 to be separated from the ink having spread over the nozzle surface. As a result, occurrence of biased ejection can be suppressed.

In addition, by selecting the reset waveform as the drive waveform used for recording the first pixel, ink is stably ejected even when dots are formed by the nozzle 18 after a long non-ejection period. This improves the characteristic of intermittent ejection. Consequently, at the start of printing a single page or at the start of each page in successive print operations, occurrence of inaccurate printing or ejection failure is suppressed.

Figure 13:
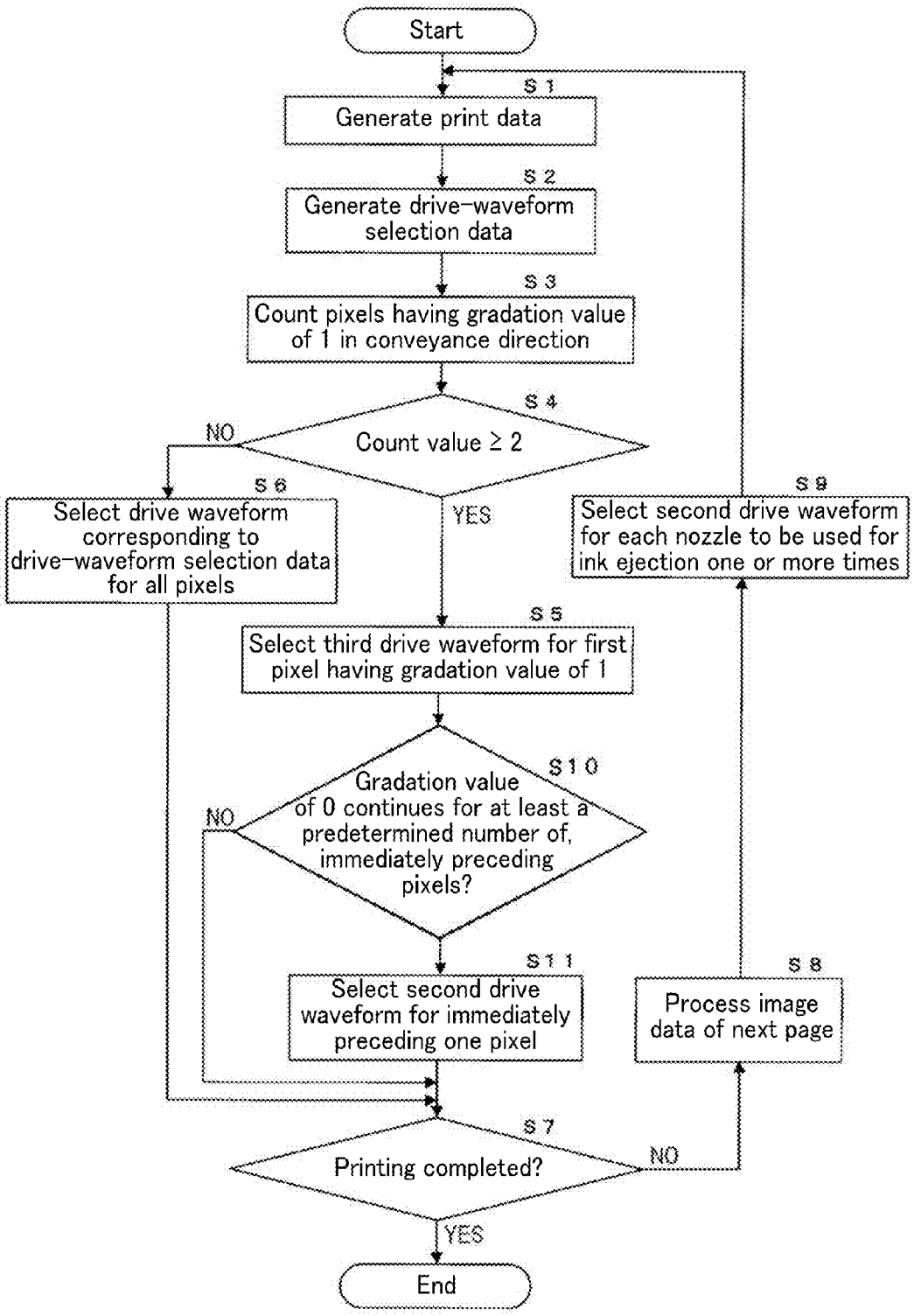
FIG. 13 is a flowchart showing a second sequence of the ink ejecting operation performed by the inkjet recording apparatus according to the embodiment of the present disclosure.

FIG. 13 is a flowchart showing a second sequence of the ink ejecting operation performed by the inkjet recording apparatus 100 according to the present embodiment. The following describes one example of an ink ejecting operation performed by the inkjet recording apparatus 100 for forming an image, mainly with reference to FIG. 13.

As shown in FIG. 13, through the second sequence, the drive-waveform selection data (ii) is generated from the print data (i) (Steps S1 and S2). In addition, the number of pixels corresponding to the drive-waveform selection data (ii) indicating a value other than 0 is counted for each pixel array (Step S3). For recording a pixel array corresponding to the count value is 2 or greater, the third drive waveform (3) is selected (Steps S4 and S5). These processes (Steps S1 through S5 shown in FIG. 13) are the same as the first sequence (Steps S1 through S5 shown in FIG. 12).

In the second sequence, after the third drive waveform (3) is selected, the control section 20 (CPU, for example) determines whether or not the gradation value of 0 (blank pixel) continues for at least a predetermined number of pixels (5 to 10 pixels, for example) immediately preceding the pixel for which the third drive waveform (3) is selected (Step S10). When it is determined that the gradation value of 0 continues for at least the predetermined number of pixels (Step S10: YES), the selector 30 selects the second drive waveform (2) as the drive waveform for recording one pixel immediately preceding the pixel for which the third drive waveform (3) is selected (Step S11). As a result, the second drive waveform (2) causes the meniscus surface M to oscillate.

Thereafter, whether or not printing has been completed for the one page is determined (Step S7). When the printing still continues (Step S7: NO), the image data (print data) for the subsequent page is processed (Step S8). In addition, for each nozzle 18 that is to be used for ejecting ink at least one time for the subsequent page, the second drive waveform (2) is applied to cause meniscus oscillation (Step S9). These processes (Steps S7 through S9 shown in FIG. 13) are the same as the first sequence (Steps S7 through S9 shown in FIG. 12).

By carrying out the ink ejecting operation of each recording head 17 through the above procedure, the following is ensured on condition that at least the predetermined number of consecutive pixels immediately preceding the pixel for which the reset waveform (third drive waveform) is selected are blank pixels. That is, meniscus oscillation is caused by the second drive waveform (2) prior to ink ejection caused by the reset waveform (third drive waveform). This enhances the effect of drawing the meniscus surface M in the nozzle 18 after a long non-ejection period.

The present disclosure is not limited to the embodiment described above, and various modifications may be made without departing from the gist of the present disclosure.

Figure 14:
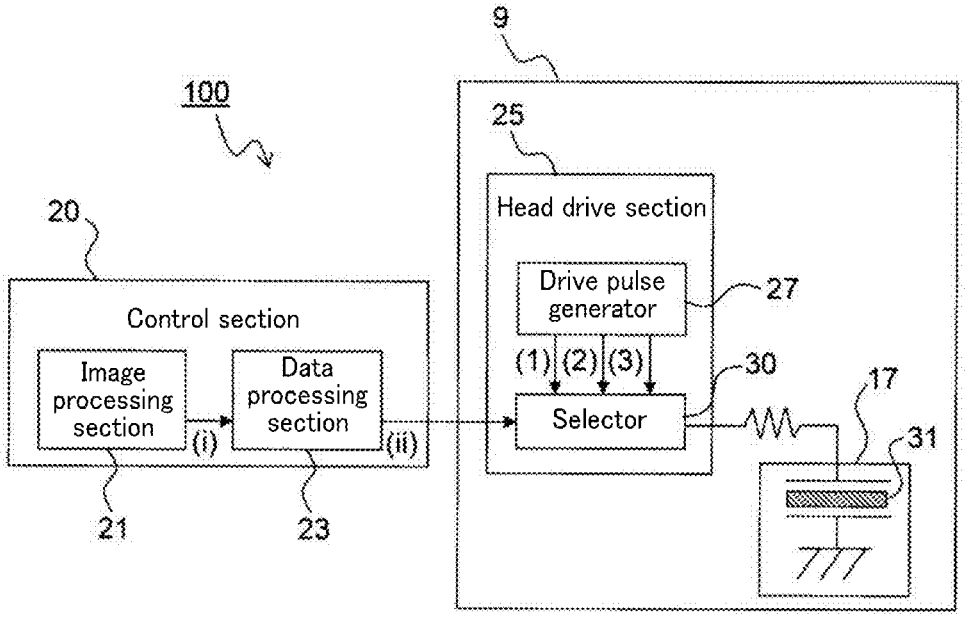
FIG. 14 is a block diagram showing another example of the control system of the inkjet recording apparatus according to the embodiment of the present disclosure.

FIG. 14 is a block diagram showing another example of the control system used by the inkjet recording apparatus 100. In the example shown in FIG. 14, the head driving section 25 is not provided with the buffer 29. The data processing section 23 included in the control section 20 generates the drive-waveform selection data (ii) for a one-page image and also stores the drive-waveform selection data (ii) thus generated.

The selector 30 controls the drive voltage for the piezoelectric elements 31 based on the drive-waveform selection data (ii) for the one-page image data stored in the data processing section 23. For example, the selector 30 selects, for each nozzle 18, which of the drive waveforms generated by the drive pulse generator 27 is to be applied to the piezoelectric element 31 or not to apply any of the drive waveforms to the piezoelectric element 31. The procedure for selecting the drive waveforms is the same as Steps S3 through S6 shown in FIG. 12, and therefore a description thereof is omitted.

In the example shown in FIG. 14, the data processing section 23 stores the drive-waveform selection data (ii) for the one-page image. That is, the buffer 29 for storing the drive-waveform selection data (ii) for a one-page image is no longer necessary, which facilities to simplify the configuration for control.

According to the embodiment described above, the drive-waveform selection data (ii) is described as two-value gradation data which takes the gradation value 0 or 1. However, the drive-waveform selection data (ii) is not limited to such and may alternatively be three-value gradation data which takes the gradation value of 0, 1, or 2 or even be gradation data having four or more values.

The third drive waveform (3), which is the reset waveform, may be more effective to increase the flow rate of the ink within the nozzle 18 than the first drive waveform (1), which is the normal ink-ejection drive waveform. In addition, the third drive waveform (3) may be more effective to increase the power of ink ejection than the first drive waveform (1). For this reason, pixels recorded by using the third drive waveform (3) tend to be high in density. Therefore, when the drive-waveform selection data (ii) is gradation data having three or more values, it is preferable to associate the third drive waveform (3) with the gradation value 2, which is one value greater than that in the embodiment described above.

The description of the embodiment given above is directed to the method for switching the drive waveform used to record pixels other than blank pixels in a one-page image from the normal ejection waveform to the reset waveform. However, the present disclosure is not limited to this, and the reset waveform may be used for blank pixels in one-page image. Alternatively, the reset waveform may be used during an interval between successive print operations. In this case, it is preferable to provide a cleaner section for cleaning the conveyance surface of the first conveyance belt 8 facing toward the recording section 9.

Settings such as the number and intervals of the nozzles 18 included in each recording head 17 may be appropriately determined according, for example, to the specifications of the inkjet recording apparatus 100. In addition, the number of recording heads 17 included in each linehead 11 may be optionally determined. For example, one recording head 17 may be disposed for one linehead 11 or four or more recording heads 17 may be disposed for one linehead 11.

EXAMPLE

The following describes Example of the present disclosure.

The inkjet recording apparatus 100 shown in FIG. 1 was used to successively produce 500 prints of a solid image. In one case (Example of the present disclosure), the procedure shown in FIG. 12 was followed and thus the third drive waveform (3) (reset waveform) was used to cause ink ejection for the first pixel in each pixel array in the conveyance direction. In another case (Comparative Example), the first drive waveform (1) was used to cause ink ejection for all the pixels. The image on the $500^{th}$ print formed in each case was visually observed.

The prints were produced under the following conditions: the conveyance speed of paper P was set to 846.7 mm/sec, the drive frequency of each recording head 17 was set to 20 kHz, and the solid image of 3000×1000 pixels was formed on A4-size regular paper (paper P).

Figure 15A:
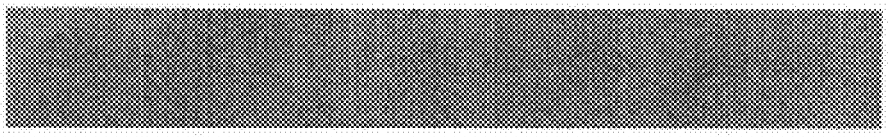
FIG. 15A is a plan view of a solid image formed, as Example, after 500 prints by using the reset waveform for the first pixel of each pixel array in the conveyance direction.
Figure 15B:
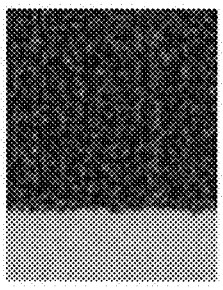
FIG. 15B is an enlarged view showing a part of FIG. 15A.

FIG. 15A and FIG. 15B (which is an enlarged view showing a part of FIG. 15A) show the evaluation results on the Example. As shown in FIG. 15A and FIG. 15B, Example achieves to form a uniform solid image even after producing 500 prints.

Figure 16A:
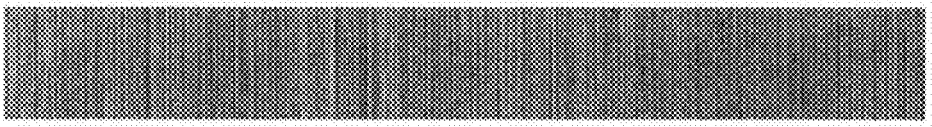
FIG. 16A is a plan view of a solid image formed, as Comparative Example, after 500 prints by using the normal ink-ejection drive waveform for all the pixels.
Figure 16B:
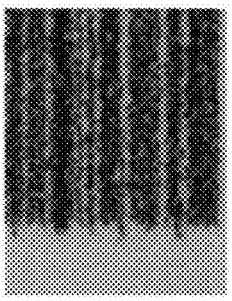
FIG. 16B is an enlarged view showing a part of FIG. 16A.

FIG. 16A and FIG. 16B (which is an enlarged view showing a part of FIG. 16A) show the evaluation results on the Comparative Example. As shown in FIG. 16A and FIG. 16B, the Comparative Example results in that a solid image formed after 500 prints contained streaks as a result of uneven density.

The above results confirm that use of the reset waveform for ejecting ink for the first pixel in each pixel array in the conveyance direction can suppress occurrence of streaks resulting from biased ejection (trajectory deflection) of ink after successive print operations to a level practically negligible. In the Example above, the reset waveform was used for ink ejection for the first pixel in each pixel array. It is also confirmed that the same advantageous effect was achieved with the use of the reset waveform for ink ejection for the last pixel or an intermediate pixel in each pixel array.

What is claimed is:

1. An inkjet recording apparatus comprising:

a recording head including a plurality of nozzles configured to eject ink onto a recording medium; and a head driving section configured to cause the recording head to eject the ink the number of times determined according to a gradation value of each of a plurality of pieces of pixel data constituting image data to be printed, wherein the recording head includes a plurality of pressure chambers in communication with the respective nozzles and configured to contain ink inside, and a plurality of piezoelectric elements disposed in correspondence with the respective pressure chambers and each configured to cause the ink to be ejected from the corresponding pressure chamber to the corresponding nozzle, and the head driving section includes a drive pulse generator configured to generate, as a waveform of drive voltage to be applied to the piezoelectric elements, a plurality of drive waveforms including an ink-ejection drive waveform defined according to the number of times of ink ejection to be made from the corresponding nozzle, and a reset waveform which causes greater drawing of a meniscus in the corresponding nozzle than by the ink-ejection drive waveform, and a selector configured to select, for each of the nozzles, to apply one of the drive waveforms generated by the drive pulse generator or not to apply any of the drive waveforms to the corresponding piezoelectric element, and the reset waveform is a waveform in which the ink-ejection drive waveform is followed by a pulse having a narrower pulse width than ½ of a natural oscillation period of the recording head.

2. An inkjet recording apparatus according to claim 1, further comprising a control section configured to control the selector, wherein the control section includes an image processing section configured to generate print data describing, in multi-value gradation, each of the plurality of pieces of pixel data constituting the image data to be printed, and a data processing section configured to generate drive-waveform selection data indicating, for each of the nozzles, the number of times of ink ejection corresponding to a value of the gradation of each piece of pixel data constituting the print data generated by the image processing section.

3. An inkjet recording apparatus according to claim 2, further comprising a conveyance unit configured to convey the recording medium in a predetermined conveyance direction, wherein the control section counts the number of pixels corresponding to the drive-waveform selection data indicating a value other than 0, for each pixel array in the conveyance direction from among the pixels of an image to be printed, and in recording a pixel array corresponding to the count value equal to 2 or greater, the selector selects the reset waveform one or more times during an interval between a print start of the image to be printed and a print start of a subsequent image.

4. An inkjet recording apparatus according to claim 3, wherein in recording the pixel array corresponding to the count value equal to 2 or greater, the selector selects the reset waveform as a drive waveform for recording at least one pixel from among the pixels, in the pixel array, corresponding to the drive-waveform selection data indicating a value other than 0.

5. An inkjet recording apparatus according to claim 4, wherein in recording the pixel array corresponding to the count value equal to 2 or greater, the selector selects the reset waveform as a drive waveform for recording a first pixel or a last pixel from among the pixels, in the pixel array, corresponding to the drive-waveform selection data indicating a value other than 0.

6. An inkjet recording apparatus according to claim 5, wherein in recording the pixel array corresponding to the count value equal to 2 or greater, the selector is configured to select the reset waveform as a drive waveform for recording the first pixel from among the pixels, in the pixel array, corresponding to the drive-waveform selection data indicating a value other than 0.

7. An inkjet recording apparatus according to claim 3, wherein the drive pulse generator generates a meniscus-oscillation drive waveform which causes a meniscus surface in the corresponding nozzle to oscillate without causing ejection of the ink, and in recording the pixel array corresponding to the count value equal to 2 or greater, the selector selects the reset waveform as a drive waveform for recording at least one pixel corresponding to the drive-waveform selection data indicating a value other than 0, and additionally selects the meniscus-oscillation drive waveform as a drive waveform for recording a pixel that immediately precedes the pixel for which the reset waveform is selected, when a predetermined number or more pixels immediately preceding the pixel for which the reset waveform is selected consecutively correspond to the drive-waveform selection data indicating a value of 0.

8. An inkjet recording apparatus according to claim 1, wherein the drive pulse generator generates a meniscus-oscillation drive waveform which causes a meniscus surface in the corresponding nozzle to oscillate without causing ejection of the ink.

9. An inkjet recording apparatus according to claim 8, wherein the meniscus-oscillation drive waveform includes a plurality of pulses each having a narrower pulse width than a pulse width of the ink-ejection drive waveform, and a frequency of the meniscus-oscillation drive waveform is higher than a frequency of the ink-ejection drive waveform.

10. An inkjet recording apparatus according to claim 8, wherein the selector selects, during an interval between successive print operations, the meniscus-oscillation drive waveform as a drive waveform for each nozzle to be used to eject ink onto a subsequent recording medium at least one time.

* * * * *